US011762308B2

(12) United States Patent
Ishii et al.

(10) Patent No.: US 11,762,308 B2
(45) Date of Patent: Sep. 19, 2023

(54) IMAGING SYSTEM WITH NON-CONTACT CHARGING DEVICE AND CONTROLLER THEREOF

(71) Applicant: Hewlett-Packard Development Company, L.P., Spring, TX (US)

(72) Inventors: Yasuyuki Ishii, Yokohama (JP); Yoichi Yoshida, Yokohama (JP); Koichiro Takashima, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/416,633

(22) PCT Filed: Aug. 24, 2020

(86) PCT No.: PCT/US2020/047577
§ 371 (c)(1),
(2) Date: Jun. 21, 2021

(87) PCT Pub. No.: WO2021/045919
PCT Pub. Date: Mar. 11, 2021

(65) Prior Publication Data

US 2022/0187732 A1 Jun. 16, 2022

(30) Foreign Application Priority Data

Sep. 2, 2019 (JP) ..... 2019-159576

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
See application file for complete search history.

(56) References Cited

U.S. PATENT DOCUMENTS 5,697,010 A 12/1997 Masuda et al.
7,340,200 B2 3/2008 Kosuge
(Continued)

FOREIGN PATENT DOCUMENTS

JP 2004061560 A * 2/2004
JP 2005242390 9/2005
(Continued)

OTHER PUBLICATIONS

Machine translation of JP2008033014 (Year: 2008).*
Machine translation for JP2004061560 (Year: 2004).*

*Primary Examiner* — Walter L Lindsay, Jr.
*Assistant Examiner* — Andrew V Do
(74) *Attorney, Agent, or Firm* — Foley & Lardner LLP

(57) ABSTRACT

An imaging system includes a photoreceptor including a surface to form a static latent image, a non-contact charging device being spaced apart from the photoreceptor, a power source to apply a voltage to the charging device, and a controller. The charging device charges an image-forming portion of the surface of the photoreceptor during an image-forming period and charges a non-image-forming portion of the surface of the photoreceptor during a non-image-forming period. The controller changes a signal parameter of the voltage to be applied by the power source during the non-image-forming period, in order to adjust a current flowing from the charging device to the photoreceptor.

19 Claims, 9 Drawing Sheets

(56) References Cited

U.S. PATENT DOCUMENTS

| | | | | |
|---|---|---|---|---|
| 7,764,888 | B2 | 7/2010 | Hagiwara et al. | |
| 8,737,854 | B2 | 5/2014 | Zaretsky | |
| 8,913,923 | B2 | 12/2014 | Kosuge et al. | |
| 2006/0039719 | A1* | 2/2006 | Tokumasu ..... | G03G 15/0258 399/176 |
| 2006/0078353 | A1* | 4/2006 | Kosuge ..... | G03G 15/0233 399/176 |
| 2009/0297206 | A1* | 12/2009 | Fujishiro ..... | G03G 21/0058 15/256.52 |
| 2019/0129334 | A1 | 5/2019 | Kimura | |

FOREIGN PATENT DOCUMENTS

| | | | | |
|---|---|---|---|---|
| JP | 2006171282 | A | | 6/2006 |
| JP | 2006-251482 | A | | 9/2006 |
| JP | 2008003342 | | | 1/2008 |
| JP | 2008033014 | A | * | 2/2008 |
| JP | 4854722 | B2 | | 1/2012 |
| JP | 5791350 | B2 | | 10/2015 |
| JP | 2016126193 | | | 7/2016 |

* cited by examiner

IMAGING SYSTEM WITH NON-CONTACT CHARGING DEVICE AND CONTROLLER THEREOF

BACKGROUND

An imaging apparatus may include a charging device that is disposed in a non-contact manner with respect to a photoreceptor, in order to reduce the wear of the photoreceptor. In such an imaging apparatus, a voltage in which an AC voltage component is superimposed on a DC voltage component is applied to the charging device, and thus, the surface of the photoreceptor is homogeneously charged.

DETAILED DESCRIPTION

Hereinafter, an example imaging system will be described with reference to the drawings. The imaging system may be an imaging apparatus such as a printer or the like, according to some examples, or may be a device that is used in an imaging apparatus, such as a developing device or the like, according to other examples.

In the following description, with reference to the drawings, the same reference numbers are assigned to the same components or to similar components having the same function, and overlapping description is omitted.

Figure 1:
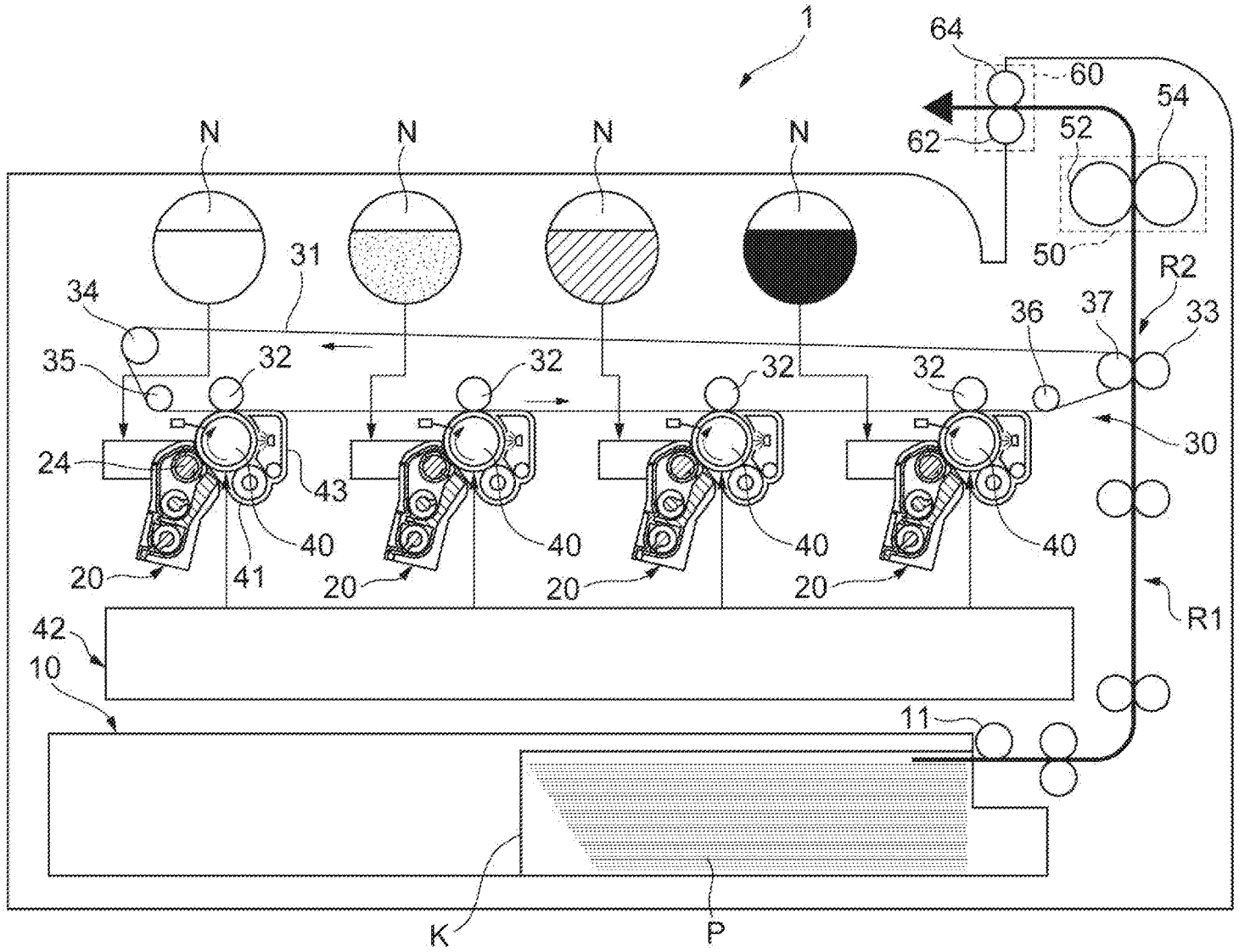
FIG. 1 is a schematic view of an example imaging apparatus.

With reference to FIG. 1, an example imaging apparatus 1 is a device that forms a color image by using the colors of magenta, yellow, cyan, and black. The imaging apparatus 1 includes a conveying device 10 that conveys a recording medium such as paper (or paper sheet) P, a developing device 20 that develops a static latent image, a transfer device 30 that secondarily transfers a toner image to the paper P, a photoreceptor 40 that includes a surface (a circumferential surface) on which the static latent image is formed, a fixing device 50 that fixes the toner image onto the paper P, and an ejection device 60 that ejects the paper P.

The conveying device 10 conveys the paper P as the recording medium on which an image is to be formed, along a conveyance route R1. The paper P is stacked and contained in a cassette K, and is conveyed by being picked up with a paper feeding roller 11. The conveying device 10 allows the paper P to reach a transfer nip region R2 through the conveyance route R1 at a timing when the toner image to be transferred to the paper P reaches the transfer nip region R2.

Four developing devices 20 are provided, with one developing device 20 for each color. Each of the developing devices 20 includes a developer carrying body 24 that carries the toner on the photoreceptor 40. In the developing device 20, a two-component developer containing a toner (e.g., in the form of toner particles) and a carrier (e.g., in the form of carrier particles) is used as a developer. A mixing ratio of the toner and the carrier is adjusted in the developing device 20, to a predetermined or targeted mixing ratio, and the toner is homogeneously dispersed by being mixed and stirred, to obtain a developer with an optimal charge amount. The developer is carried on the developer carrying body 24. When the developer is transferred, for example by a rotational movement of the developer carrying body, to a developing region facing the photoreceptor 40, the toner in the developer that is carried on the developer carrying body 24 is moved or transferred to the static latent image that is formed on the circumferential surface of the photoreceptor 40, so as to develop the static latent image.

The transfer device 30 conveys the toner image that is formed by the developing device 20 to the transfer nip region R2 where the toner image is secondarily transferred to the paper P. The transfer device 30 includes a transfer belt 31 to which the toner image is primarily transferred from the photoreceptor 40, suspension rollers 34, 35, 36, and 37 suspending (or supporting) the transfer belt 31, a primary transfer roller 32 adjacent the photoreceptor 40 to interpose the transfer belt 31 between the primary transfer roller 32 and the photoreceptor 40, and a secondary transfer roller 33 adjacent the suspension roller 37 to interpose the transfer belt 31 between the secondary transfer roller 33 and the suspension roller 37. The transfer belt 31 is an endless belt that engages the suspension rollers 34, 35, 36, and 37 to move circularly. The suspension rollers 34, 35, 36, and 37 are rollers that are rotatable around respective axis lines. The suspension roller 37 may be a driving roller that is rotationally driven around the axis line, and the suspension rollers 34, 35, and 36 may be driven rollers that are driven to be rotated in accordance with the rotational driving of the suspension roller 37. The primary transfer roller 32 is positioned to press against the photoreceptor 40 from an inner circumferential side of the transfer belt 31. The secondary transfer roller 33 extends in parallel with and adjacent to the suspension roller 37 to interpose the transfer belt 31 between the secondary transfer roller 33 and the suspension roller 37. The secondary transfer roller 33 is positioned to press against the suspension roller 37 from an outer circumferential side of the transfer belt 31. Accordingly, the secondary transfer roller 33 forms the transfer nip region R2 between the secondary transfer roller 33 and the transfer belt 31.

The photoreceptor 40 may also be referred to as a static latent image carrying body, a photoreceptor drum, and/or the like. Four photoreceptors 40 are provided for the respective four colors. The photoreceptors 40 are spaced apart along a movement direction of the transfer belt 31. The developing device 20, a charging device 41, an exposure unit (or exposure device) 42, and a cleaning unit (or cleaning device) 43 are positioned circumferentially about the photoreceptor 40.

The charging device 41 includes a charging roller that is provided in a non-contact manner with respect to the photoreceptor 40, to homogeneously (or uniformly) charge the surface of the photoreceptor 40 to a predetermined potential.

The exposure unit (or device) 42 exposes the surface of the photoreceptor 40 that has been previously charged by the charging device 41, in accordance with the image to be formed on the paper P. Accordingly, the potential of a portion of the surface of the photoreceptor 40 that has been exposed by the exposure unit 42, is changed to form the static latent image. The four developing devices 20 develop the static latent image formed on the respective four photoreceptors 40 with the toner that is supplied from respective toner tanks N that face the respective developing devices 20, to generate the toner image. The toner tanks N are filled with toner of the respective colors of magenta, yellow, cyan, and black. The cleaning unit (or device) 43 collects the toner that remains on the adjacent photoreceptor 40 after the toner image that is formed on the photoreceptor 40 is primarily transferred to the transfer belt 31.

The fixing device 50 directs the paper P to pass through a fixing nip region in which heating and pressuring are performed, to attach and fix the toner image that has been secondarily transferred to the paper P from the transfer belt 31 to the paper P. The fixing device 50 includes a heating roller 52 that heats the paper P, and a pressure roller 54 that presses against the heating roller 52 and that is rotationally driven. The heating roller 52 and the pressure roller 54 have a cylindrical shape. The heating roller 52 may include a heat source such as a halogen lamp. The fixing nip region provides a contact region between the heating roller 52 and the pressure roller 54. The paper P is conveyed to pass through the fixing nip region, to melt the toner image and fix the toner image to the paper P.

The ejection device 60 includes ejection rollers 62 and 64 for ejecting the paper P to which the toner image has been fixed, to the outside of the imaging apparatus.

The imaging apparatus 1 further includes a power source 70 and a controller 72. The power source 70 applies a voltage to the charging device 41 for charging the photoreceptor 40. The controller 72 controls the overall operation of the imaging apparatus 1. The example power source 70 and the example controller 72 will be described further below.

A printing process of the imaging apparatus 1 will be described. When an image signal of an image to be recorded on a recording medium, is input to the imaging apparatus 1, the controller 72 (cf. FIG. 2) of the imaging apparatus 1 controls the paper feeding roller 11 to rotate, to pick-up (or lift) a sheet of the paper P that is stacked in the cassette K and to convey the sheet of paper P. The surface of the photoreceptor 40 is homogeneously charged to a predetermined potential by the charging device 41 (a charging operation). The surface of the photoreceptor 40 having been charged is subsequently irradiated with a laser light by the exposure unit (or device) 42, based on the received image signal, to form the static latent image (an exposure operation).

In the developing device 20, the static latent image is developed, and the toner image is formed (a developing operation). The formed toner image is primarily transferred to the transfer belt 31 from the photoreceptor 40, from a region of the photoreceptor 40 that faces the transfer belt 31 (a transfer operation). Four toner images are formed by the four photoreceptors 40 and are sequentially layered on the transfer belt 31, to form a single composite toner image. Then, the composite toner image is secondarily transferred to the paper (or paper sheet) P that is conveyed from the conveying device 10, at the transfer nip region R2 where the suspension roller 37 and the secondary transfer roller 33 face each other.

The paper P to which the composite toner image has been secondarily transferred, is then conveyed to the fixing device 50. When the paper P passes through the fixing nip region, the paper P is heated and pressured by the fixing device 50 between the heating roller 52 and the pressure roller 54, to melt the composite toner image and to fix the toner image to the paper P (a fixing operation). After that, the paper P is ejected to the outside of the imaging apparatus 1 by the ejection rollers 62 and 64.

The example photoreceptor 40, the example charging device 41, the example power source 70, and the example controller 72 will be described, with reference to FIG. 2.

Figure 2:
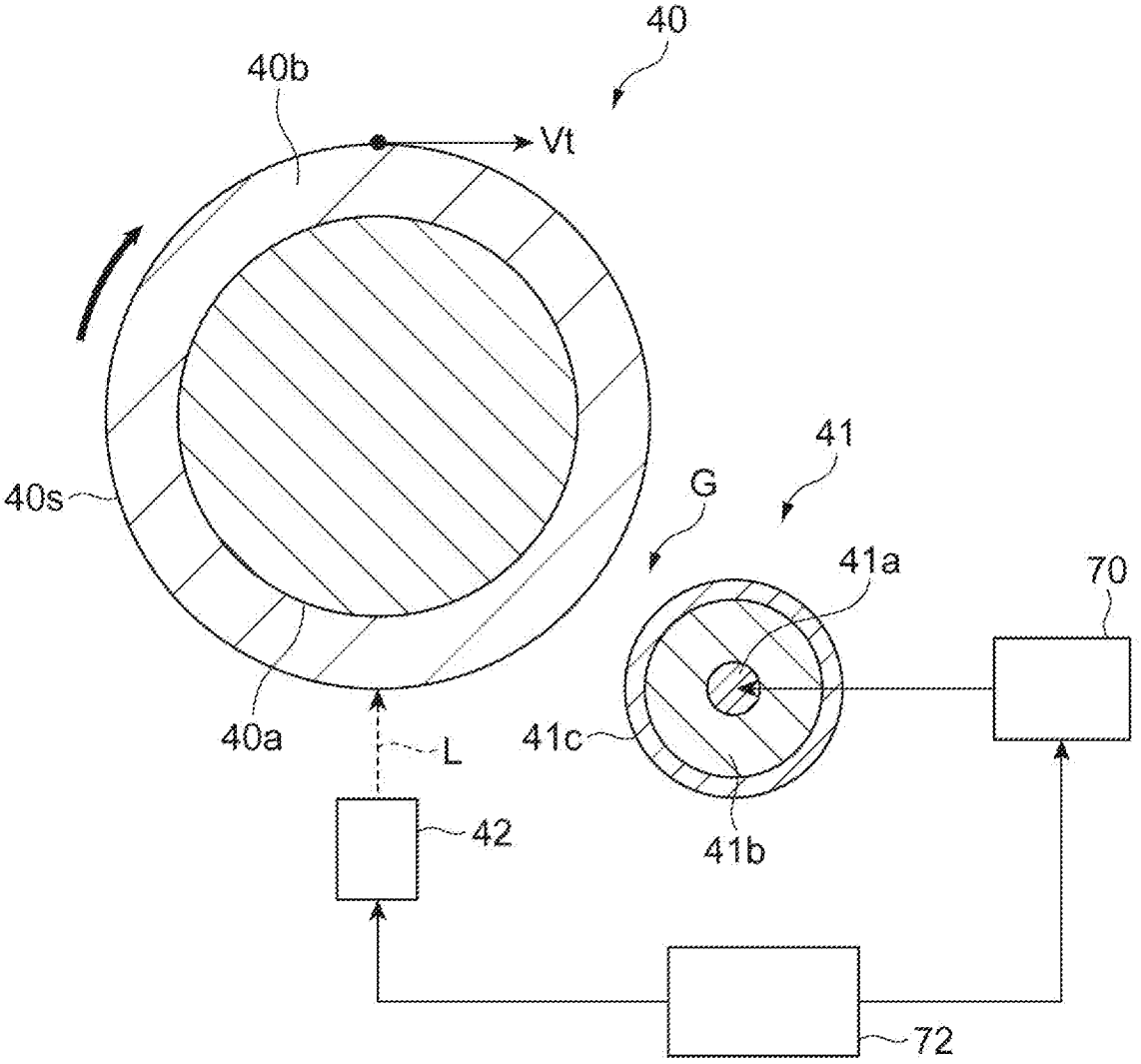
FIG. 2 is a schematic sectional view of a photoreceptor and a charging device according to an example.

As illustrated in FIG. 2, the photoreceptor 40 may include a surface 40*s* for forming the static latent image. The photoreceptor 40, for example, may be an organic photoconductor (OPC), and may include a substrate (or substrate member) 40*a*, and a photosensitive layer 40*b* that is provided over the substrate 40*a*.

The substrate 40*a* may have a substantially cylindrical or columnar shape, and supports the photosensitive layer 40*b*. The substrate 40*a* may include a conductive material such as aluminum, copper, chromium, nickel, zinc, and stainless steel. An outer circumferential surface of the substrate 40*a* may be covered with the photosensitive layer 40*b*.

The photosensitive layer 40*b* is a layer on which the static latent image is formed, and for example, in the photosensitive layer 40*b*, a charge generating layer and a charge transport layer may be layered in this order from the substrate 40*a* layer (e.g. in a radially outward direction). Accordingly, the charge transport layer forms a surface layer of the photoreceptor 40. The charge generating layer has a charge generating function, and for example, may include a binder resin in which charge generating substance(s) are dispersed. The charge generating substance may be of one or more among: a monoazo pigment, a disazo pigment, an asymmetric disazo pigment, a trisazo pigment, an azo pigment having a carbazole skeleton, an azo pigment having a distyryl benzene skeleton, an azo pigment having a triphenyl amine skeleton, an azo pigment having a diphenyl amine skeleton, a perylene pigment, a phthalocyanine pigment, and/or the like, for example. The charge generating substance(s) may include a single one of the above-listed types according to examples, or two or more types thereof may be mixed together according to other examples. Furthermore, an intermediate layer, such as an undercoat layer, may be further formed between the substrate 40*a* and the charge generating layer of the photosensitive layer 40*b*.

The charge transport layer (a layer configured of an organic compound) is formed of an organic compound, and includes the outermost layer of the photoreceptor 40. The charge transport layer has a charge transport structure, and for example, may be formed of a binder resin in which charge transport substances are dispersed. The charge transport substance contained in the charge transport layer, for example, may include a hole transport substance. The hole transport substance may include one or more among: Poly (N-vinyl carbazole) and/or a derivative thereof, poly(γ-carbazolyl ethyl glutamate) and/or a derivative thereof, pyrene-formaldehyde condensation and/or a derivative thereof, polyvinyl pyrene, polyvinyl phenanthrene, polysilane, an oxazole derivative, an oxadiazole derivative, an imidazole derivative, a monoaryl amine derivative, a diaryl amine derivative, a triaryl amine derivative, a stilbene derivative, an α-phenyl stilbene derivative, an aminobiphenyl derivative, a benzidine derivative, a diaryl methane derivative, a triaryl methane derivative, a 9-styryl anthracene derivative, a pyrazoline derivative, a divinyl benzene derivative, a hydrazone derivative, an indene derivative, a butadiene derivative, a pyrene derivative, a bisstilbene derivative, a distyryl benzene derivative, an enamine derivative, and/or the like. The hole transport substances may include a single one of the above-listed types according to examples, or two or more types thereof may be mixed together in other examples.

Furthermore, the charge transport substance contained in the charge transport layer may include an electron transport substance. Examples of electron transport substances include: a benzoquinone-based compound, a cyan ethylene-based compound, a cyanoquinodimethane-based compound, a fluorenone-based compound, a phenantraquinone-based compound, a phthalic anhydride-based compound, a thiopyran-based compound, a naphthalene-based compound, a diphenoquinone-based compound, and a stilbene quinone-based compound. Some additional examples of electron transport substances include: chloranil, bromanil, tetracyanoethylene, tetracyanoquinodimethane, 7-trinitro-9-fluorenone, and the like. The charge transport layer may include one among such electron transport substances according to some examples, or may include two or more types thereof mixed together.

The charge transport layer may further contain filler particles. Organic filler particles and/or inorganic filler particles may be used as the filler particles contained in the charge transport layer. Examples of organic filler particles include a urethane resin, a polyamide resin, a fluorine resin, a nylon resin, an acrylic resin, a urea resin, and the like. Examples of organic filler particles include silica, alumina, and the like. The charge transport layer may include one of such filler particles according to some examples, or may include two or more types thereof mixed together according to other examples.

The charge transport layer includes filler particles formed of a material that is less likely to be affected by discharge than an organic compound, to suppress wear of the photoreceptor 40 due to discharge that occurs between the photoreceptor 40 and the charging device 41. In order to more effectively suppress the wearing of the photoreceptor 40, the filler particles may have an average particle diameter of approximately 50 to 500 nm. In addition, the charge transport layer contains a ratio of approximately 1 to 30 mass % of the filler particles.

An outer circumferential surface of the photosensitive layer 40*b* forms the surface 40*s* of the photoreceptor 40. The surface 40*s* of the photoreceptor 40 is homogeneously or uniformly charged by the charging device 41, to form a charged surface on the surface 40*s* of the photoreceptor 40. The charged surface is irradiated with light L from the exposure unit (or device) 42, to form the static latent image. As described above, the charge transport layer (or surface layer) of the photosensitive layer 40*b* may form the uppermost (or outermost) layer of the photoreceptor 40, and a protective layer formed of an acrylic resin or the like may be further formed on the charge transport layer to increase the hardness of the surface 40*s* of the photoreceptor 40, and improve wear resistance.

The photoreceptor 40 extends longitudinally, and the substrate member 40*a* has opposite ends that are rotatably supported on a support member, and are rotationally driven by power from a driving source such as a motor. The photoreceptor 40 is rotated at a rotational velocity according to a process speed of the imaging apparatus 1. The process speed of the imaging apparatus 1 is coincident with a tangential velocity (a circumferential velocity) Vt of the surface 40*s* of the photoreceptor 40. For example, the tangential velocity Vt of the photoreceptor 40 may be approximately 50 [mm/sec].

The charging device 41 is a non-contact charging device, and is provided by being spaced apart from the photoreceptor 40.

The charging device 41 is in the shape of a column, and includes a conductive support body 41*a*, a conductive elastic body layer 41*b* that is layered on an outer circumferential surface of the conductive support body 41*a*, and a conductive resin layer 41*c* that is layered on an outer circumferential surface of the conductive elastic body layer 41*b*.

The conductive support body 41*a* may have a columnar or cylindrical shape, and extends in parallel with the substrate 40*a* of the photoreceptor 40. The conductive support body 41*a* is formed of a conductive metal such as iron, copper, aluminum, nickel, and stainless steel. In an example, the outer circumferential surface of the conductive support body 41*a* may be subjected to a plating treatment in order to provide antirust performance and scratch resistance performance. In addition, the outer circumferential surface of the conductive support body 41*a* may be coated with a conductive adhesive agent or a conductive primer in order to protect the conductive elastic body layer 41*b*. The conductive support body 41*a* has opposite ends that may be rotatably supported on a support member.

The conductive elastic body layer 41*b* covers at least a part of the outer circumferential surface of the conductive support body 41*a*. The conductive elastic body layer 41*b*, for example, may be formed of a resin containing a conductive material. The conductive elastic body layer 41*b*, for example, may be formed of a material in which a conductive material is added to natural rubber, synthetic rubber, a synthetic resin (a polyamide resin, a polyurethane resin, a silicone resin, and the like), and the like. Examples of the conductive agent contained in the conductive elastic body layer 41*b*, include: carbon black, graphite, potassium titanate, ferric oxide, conductive titanium oxide (c-$TiO_2$), conductive zinc oxide (c-ZnO), conductive tin oxide (c-$SnO_2$), a quaternary ammonium salt, and the like.

The conductive resin layer 41*c* covers the outer circumferential surface of the conductive elastic body layer 41*b*, and configures the outermost layer of the charging device 41. The conductive resin layer 41*c* may be formed of a material having an electrical resistance that is greater than an electrical resistance of the conductive elastic body layer 41*b*. The conductive resin layer 41*c* may be formed of a material in which a conductive material is added to a base polymer such as a fluorine resin, a polyamide resin, an acrylic resin, a nylon resin, a polyurethane resin, a silicone resin, a butyral resin, a styrene-ethylene•butylene-olefin copolymer (SEBC), and an olefin-ethylene•butylene-olefin copolymer (CEBC).

The charging device 41 is spaced apart from the photoreceptor 40. A gap G is formed between the photoreceptor 40 and the charging device 41. The charging device 41 extends in parallel with the photoreceptor 40. A spaced distance (e.g., a closest distance) between the surface 40*s* of the photoreceptor 40 and the outer circumferential surface of the charging device 41 (which corresponds to the width or distance of the gap G in a facing direction of the photoreceptor 40 and the charging device 41) is set to be substantially constant along an axis line direction (or the longitudinal direction) of the photoreceptor 40. In an example, in order to ensure the homogeneity of the charge of the photoreceptor 40, the gap G in the facing direction of the photoreceptor 40 and the charging device 41 may have a constant width (or distance) of approximately 10 to 100 μm. As described above, the charging device 41 may be positioned in a non-contact manner with respect to the photoreceptor 40, as described above, to prevent wear of the photoreceptor 40 due to friction.

The power source 70 is electrically connected to the charging device 41. The power source 70 applies the voltage to the conductive support body 41*a* of the charging device 41, in order to charge the photoreceptor 40. The voltage that is applied to the conductive support body 41*a* from the power source 70 is a voltage in which a DC voltage and an AC voltage are superimposed. When the voltage is applied to the charging device 41, discharge occurs between the charging device 41 and the photoreceptor 40. By such discharge, an AC current flows from the charging device 41 to the photoreceptor 40, to charge a portion facing the charging device 41 on the surface 40*s* of the photoreceptor 40. The entire circumference of the surface (circumferential surface) 40*s* of the photoreceptor 40 is homogeneously charged with the rotation of the photoreceptor 40.

The power source 70 includes a parameter converter, convert a signal parameter of an AC voltage that is applied to the conductive support body 41*a*. The frequency and the waveform of the AC voltage are included as the signal parameter of the AC voltage that is converted by the parameter converter. The signal parameter of the AC voltage is controlled by the controller 72.

In addition, a DC component of the voltage that is applied to the conductive support body 41*a* from the power source 70 is a negative bias voltage, and for example, includes a voltage of approximately −900 to −300 [V]. An AC component of the voltage that is applied to the conductive support body 41*a*, for example, includes a peak-to-peak voltage of approximately 1500 to 3000 [V]. Such a voltage is applied to the charging device 41, and thus, discharge occurs between the charging device 41 and the photoreceptor 40, and the portion facing the charging device 41 on the surface 40*s* of the photoreceptor 40 is charged.

The surface 40*s* of the photoreceptor 40 that is charged by the charging device 41 is exposed by the light L that is output from the exposure unit (or device) 42. The exposure unit 42, for example, includes a laser light scanning device to scan a part of the surface 40*s* with laser light, in accordance with the image to be formed on the paper P. Accordingly, the potential of the portion on the surface of the photoreceptor 40 that is exposed by the exposure unit 42 is changed, to form the static latent image.

Figure 3:
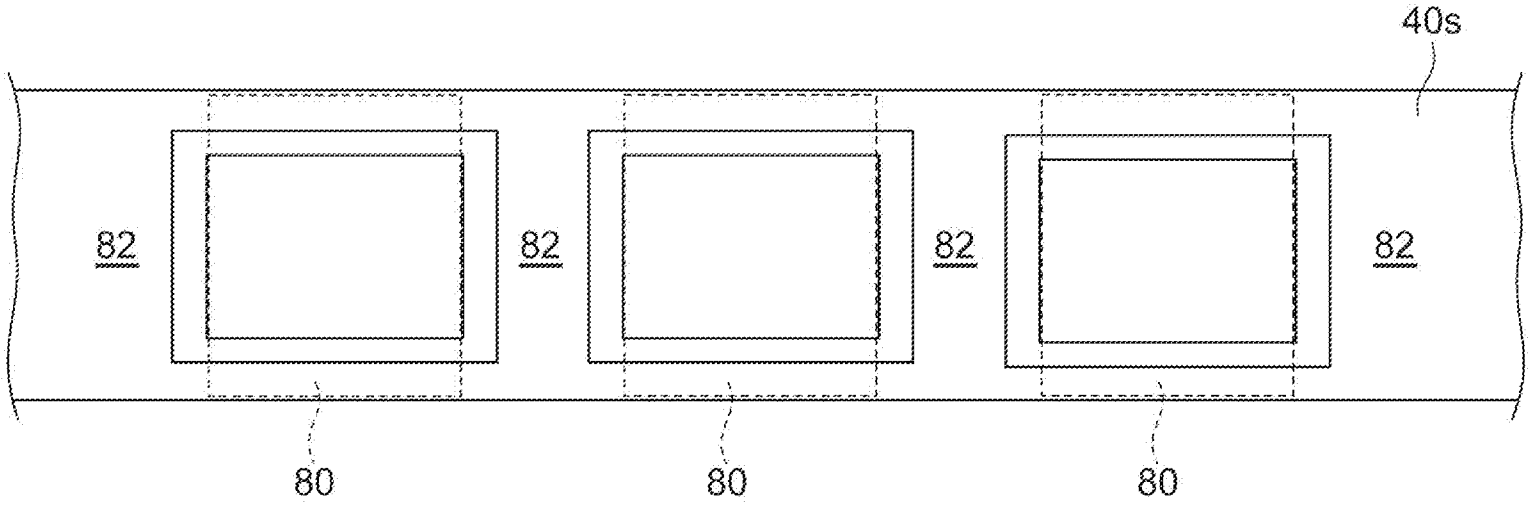
FIG. 3 is a schematic diagram of an example static latent image formed on a surface of the photoreceptor.

FIG. 3 is a diagram schematically illustrating the static latent image that is formed on the surface 40*s* of the photoreceptor 40. With reference to FIG. 3, in an imaging process that forms an image on a plurality of paper sheets (or sheets of paper) P, the surface 40*s* of the photoreceptor 40 is formed with a plurality of image-forming portions 80 in which the static latent image is generated, and with a plurality of non-image-forming portions 82 in which no static latent image is generated.

The image-forming portion 80 is a portion on the surface 40*s* of the photoreceptor 40, that is exposed by the exposure unit 42 while the photoreceptor 40 is rotated (e.g., by one rotation), such that the static latent image is formed. The image-forming portion 80 receives light corresponding to the image to be formed on the paper (or paper sheet) P, so as to form the static latent image. The non-image-forming portion 82 is a portion on the surface 40*s* of the photoreceptor 40, that is charged to remain free of exposure from the light from the exposure unit 42 while the photoreceptor 40 is rotated (e.g., by one rotation) such that no static latent image is not formed in the non-image-forming portion 82. The non-image-forming portion 82 and the image-forming portion 80 are mutually exclusive regions. Accordingly, the non-image-forming portion 82 is a region that excludes the image-forming portion 80 on the surface 40*s* of the photoreceptor 40. In some examples, the non-image-forming portion 82 may include a portion corresponding to a timing of a pretreatment period in which a charge potential of the photoreceptor 40 is stabilized, a portion corresponding to a white space, a portion corresponding to an interval between the plurality of paper sheets P to be printed, and a portion corresponding to a timing of an post-treatment period in which the photoreceptor 40 is neutralized.

The controller 72 is a computer including a processor, a storage (or storage device), an input device, a display device, and the like, and has a function of controlling the overall operation of the imaging apparatus 1. The storage device of the controller may store processor-readable data and instructions. For example, the processor-readable data and instructions may be executed by the processor as a control program for controlling various processes to be carried out by the imaging apparatus 1. The controller 72 is connected to or in communication with the power source 70 such that communication can be performed, and the signal parameter of the AC voltage that is applied to the conductive support body 41*a* may be adjusted in order to suppress the wear of the photoreceptor 40.

Figure 4:
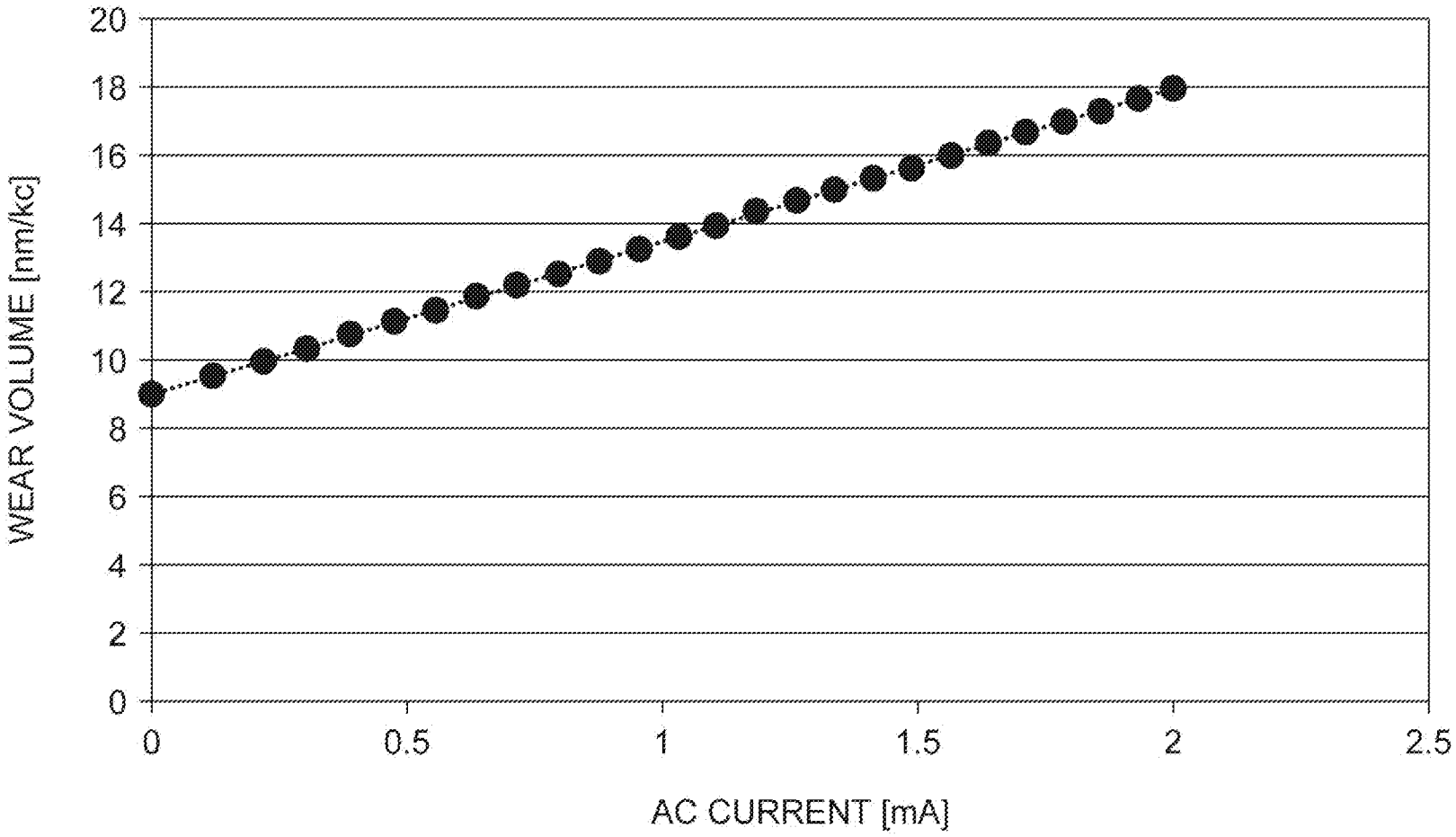
FIG. 4 is a graph of an example relationship between an amount of an AC current and a wear volume of the photoreceptor.

A wear volume of the photoreceptor 40 depends on the amount of AC current flowing to the photoreceptor 40 from the charging device 41. FIG. 4 is an example graph showing a relationship between the amount of the AC current flowing to the photoreceptor 40 from the charging device 41, and the wear volume of the photoreceptor 40. As shown in FIG. 4, the wear volume of the photoreceptor 40 increases, as the AC current that flows to the photoreceptor 40 increases. Therefore, in order to suppress the wear of the photoreceptor 40, it is necessary that the AC current flowing to the photoreceptor 40 is suppressed.

In order to suppress the wear of the photoreceptor 40, the controller 72 changes the signal parameter of the AC voltage that is applied to the charging device 41 at the time of charging the non-image-forming portion 82 of the photoreceptor 40 so as to decrease the AC current flowing to the photoreceptor 40 from the charging device 41.

Figure 5:
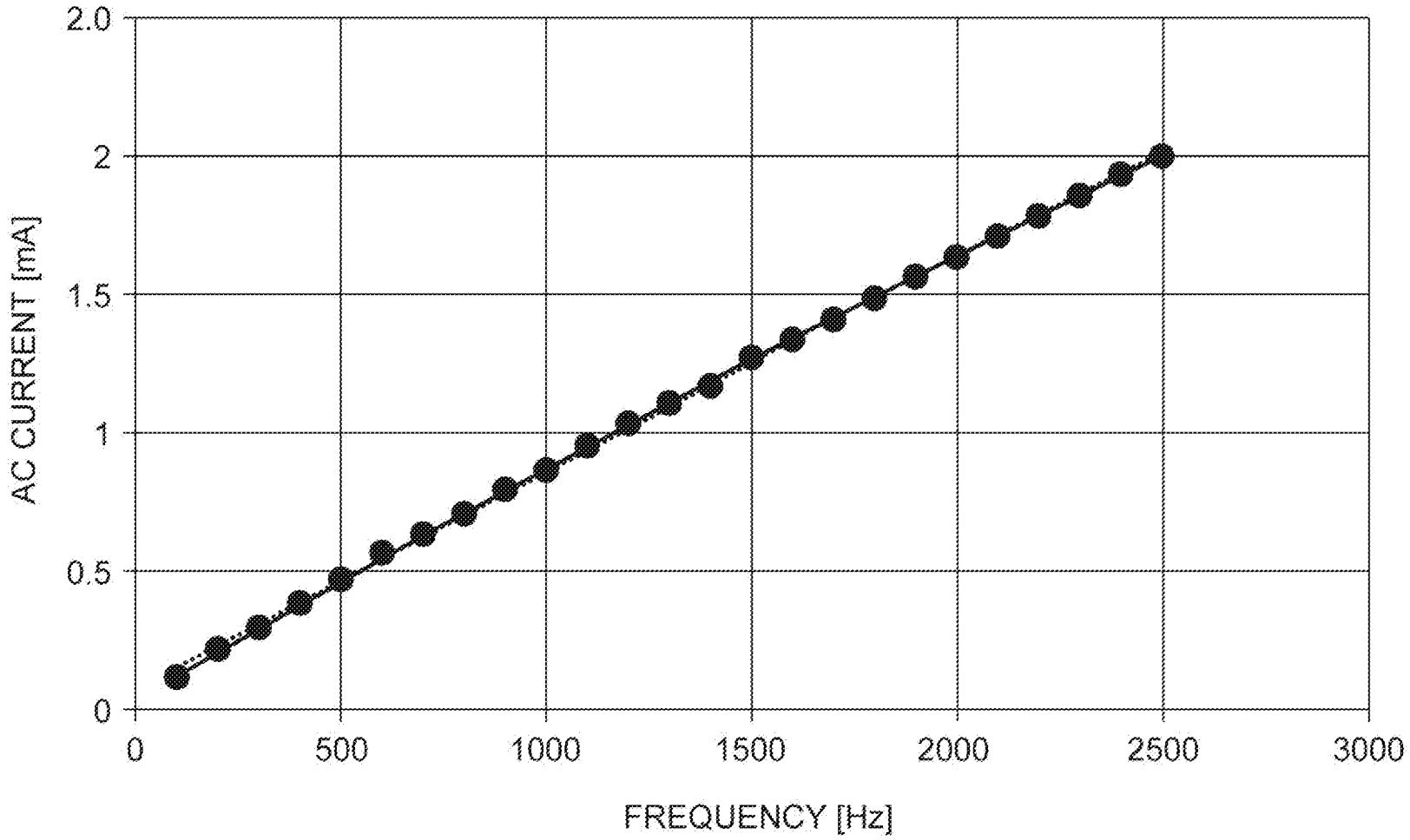
FIG. 5 is a graph of an example relationship between a frequency of an AC voltage and the amount of the AC current flowing to the photoreceptor.

FIG. 5 is an example graph showing an example relationship between the frequency of the AC voltage to be applied to the charging device 41 and the amount of the AC current flowing to the photoreceptor 40 from the charging device 41. As shown in FIG. 5, the AC current that flows to the photoreceptor 40 from the charging device 41 increases substantially linearly as the frequency of the AC voltage that is applied to the charging device 41 increases. Accordingly, the frequency of the AC voltage that is applied to the charging device 41 may be decreased to decrease the wear volume of the photoreceptor 40.

Figure 6:
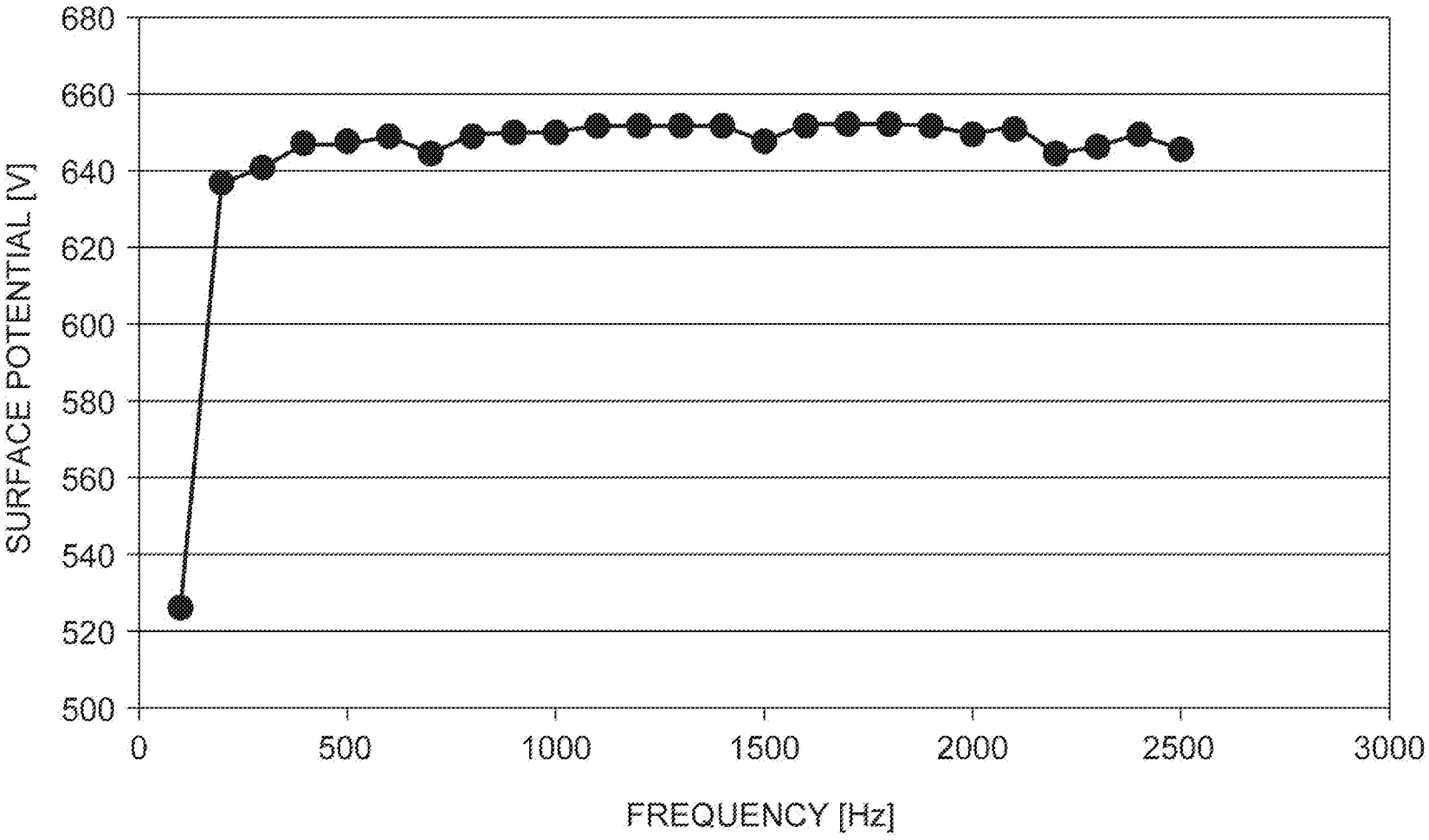
FIG. 6 is a graph of an example relationship between the frequency of the AC voltage and a surface potential of the photoreceptor.

In addition, FIG. 6 is an example graph showing an example relationship between the frequency of the AC voltage to be applied to the charging device 41 and a surface potential of the photoreceptor 40. In this example, for a frequency of the AC voltage that is equal to or greater than 300 [Hz], the surface potential of the photoreceptor 40 is substantially constant, and for a frequency of the AC voltage that is less than 300 [Hz], the surface potential of the photoreceptor 40 decreases exponentially. Accordingly, the frequency of the AC voltage may be set to be equal to or greater than a certain value in order to achieve an improved printing quality.

In view of the above-described, in some examples, the controller 72 controls the power source 70 such that a frequency of the AC voltage that is applied to the charging device 41 during a non-image-forming period (in which the non-image-forming portion 82 of the photoreceptor 40 is charged) is lower than a frequency of the AC voltage that is applied to the charging device 41 during an image-forming period (in which the image-forming portion 80 of the photoreceptor 40 is charged).

Figure 7:
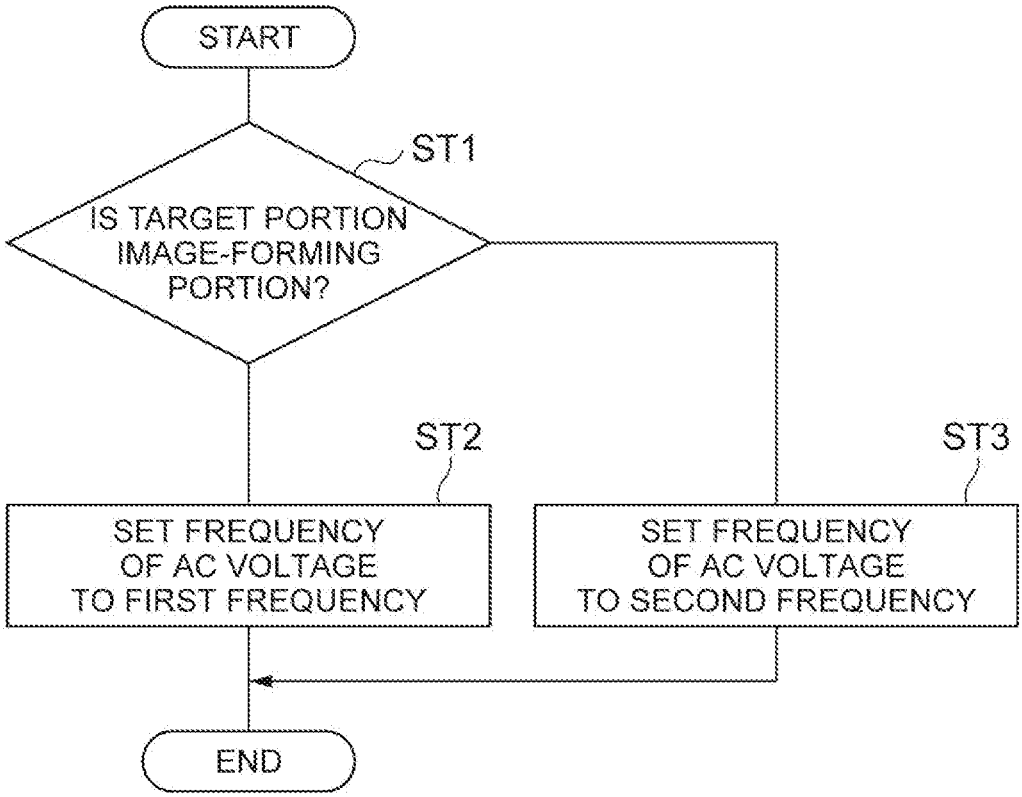
FIG. 7 is a flowchart of an example process carried out by a controller.

FIG. 7 is a flowchart illustrating an example of a control flow of the controller 72. At operation ST1, the controller 72 determines whether or not a portion to be charged by the charging device 41, on the surface 40*s* of the photoreceptor 40 (hereinafter, referred to as a "target portion") is an image-forming portion 80. In a case where the static latent image is formed in the target portion by the exposure unit (or device) 42, the controller 72 determines that the target portion is the image-forming portion 80.

In a case where it is determined that the target portion is the image-forming portion 80, at operation ST2, the controller 72 controls the power source 70, and sets the frequency of the AC voltage to be applied to the charging device 41 during the image-forming period (in which the target portion is charged) to a first frequency f1. The first frequency f1 is a high frequency for achieving a stable printing quality. In addition, the controller 72 causes the charging device 41 to charge the image-forming portion 80 by using the AC voltage having the first frequency f1. The controller 72 synchronously controls the charging device 41 and the exposure unit 42 such that the static latent image is formed in the image-forming portion 80 by the exposure unit 42.

Where it is determined that the target portion is not the image-forming portion 80 but instead the non-image-forming portion 82, at operation ST3, the controller 72 controls the power source 70 such that the frequency of the AC voltage that is applied to the charging device 41 during the non-image-forming period (in which the target portion is charged) is set to a second frequency f2. The second frequency f2 is a frequency for suppressing the AC current flowing to the photoreceptor 40 from the charging device 41, and is a frequency that is lower than the first frequency f1.

In some examples, the first frequency f1 and the second frequency f2 satisfy the following relationships.

$$f1\ [\mathrm{Hz}]/Vt[\mathrm{mm/sec}] \geq 8$$

$$1.7 < f2\ [\mathrm{Hz}]/Vt[\mathrm{mm/sec}] < 8$$

As described above, a ratio of the first frequency f1 [Hz] to the tangential velocity Vt [mm/sec] of the surface 40*s* of the photoreceptor 40 may be equal to or greater than 8. In addition, a ratio of the second frequency f2 [Hz] to the tangential velocity Vt [mm/sec] of the surface 40*s* of the photoreceptor 40 is of approximately 1.7 to 8. The AC voltage having the second frequency f2 that is a relatively low frequency is applied to the charging device 41 during the non-image-forming period, to decrease the AC current flowing to the photoreceptor 40 during the non-image-forming period, as compared with the AC current flowing to the photoreceptor 40 during the image-forming period, in order to suppress wear of the photoreceptor 40.

In some examples, the controller 72 may control the power source 70 such that the waveform of the AC voltage to be applied to the charging device 41 during the non-image-forming period (in which the non-image-forming portion 82 of the photoreceptor 40 is charged) is a waveform that is different from the waveform of the AC voltage to be applied to the charging device 41 during the image-forming period (in which the image-forming portion 80 of the photoreceptor 40 is charged).

Figure 8:
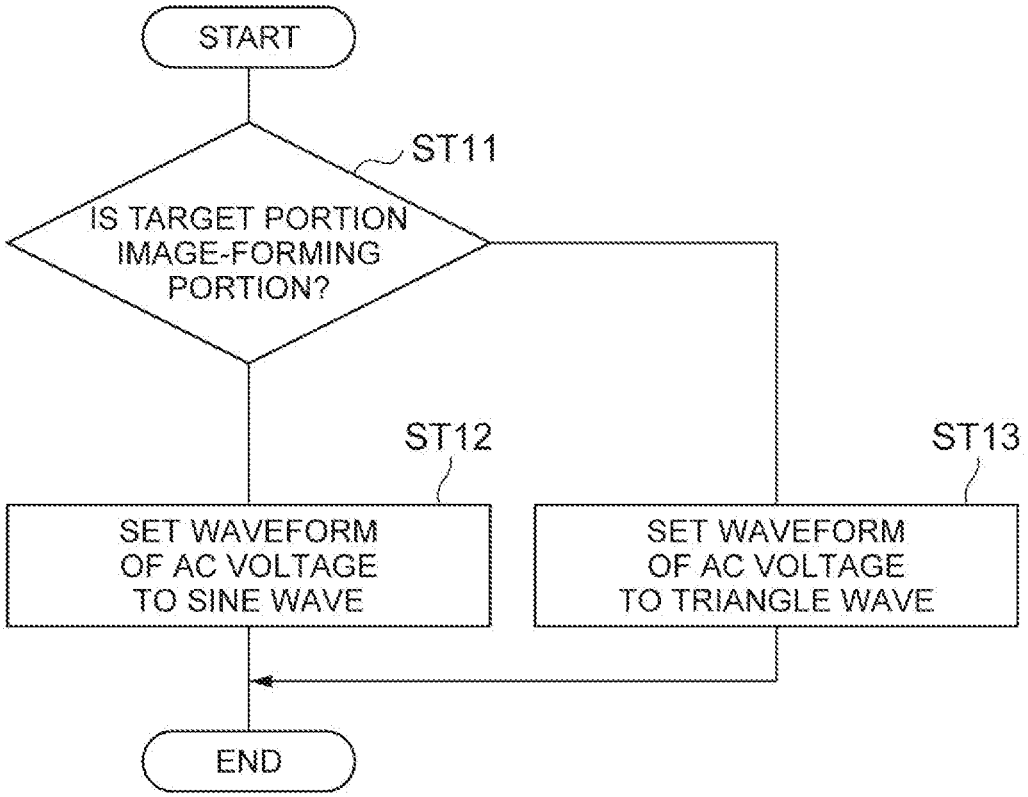
FIG. 8 is a flowchart of an example process carried out by the controller.

FIG. 8 is a flowchart illustrating a control flow of the controller 72 according to another example. At operation ST11, the controller 72 determines whether or not the target portion of the surface 40*s* of the photoreceptor 40 is an image-forming portion 80.

Where it is determined that the target portion is an image-forming portion 80, at operation ST12, the controller 72 controls the power source 70, and sets the waveform of the AC voltage to be applied to the charging device 41 during the image-forming period (in which the target portion is charged) to a sine wave. In addition, the controller 72 causes the charging device 41 to charge the image-forming portion 80 by using the AC voltage of the sine wave, and then, synchronously controls the charging device 41 and the exposure unit 42 such that the static latent image is formed in the image-forming portion 80 by the exposure unit 42.

Where it is determined that the target portion is not the image-forming portion 80 but the non-image-forming portion 82, at operation ST13, the controller 72 controls the power source 70, and sets the waveform of the AC voltage that is applied to the charging device 41 during the non-image-forming period (in which the target portion is charged) to a triangle wave (operation ST13). An average voltage of the triangle wave is lower than an average voltage of the sine wave, and accordingly, the waveform of the AC voltage that is applied to the charging device 41 during the non-image-forming period is changed to the triangle wave, to decrease the AC current flowing to the photoreceptor 40 while maintaining the peak-to-peak voltage, in order to suppress or inhibit wear of the photoreceptor 40.

Furthermore, the controller 72 may change both of the frequency and the waveform of the AC voltage that is applied to the charging device 41 during the non-image-forming period. For example, the controller 72 may set the waveform of the AC voltage that is applied to the charging device 41 to the sine wave, and may set the frequency of the AC voltage to the first frequency f1, during the image-forming period. The controller 72 may set the waveform of the AC voltage that is applied to the charging device 41 to the triangle wave, and may set the frequency to the second frequency f2, during the non-image-forming period. The controller 72 may control both the frequency and the waveform, to suppress or inhibit wear of the photoreceptor 40.

Figure 9:
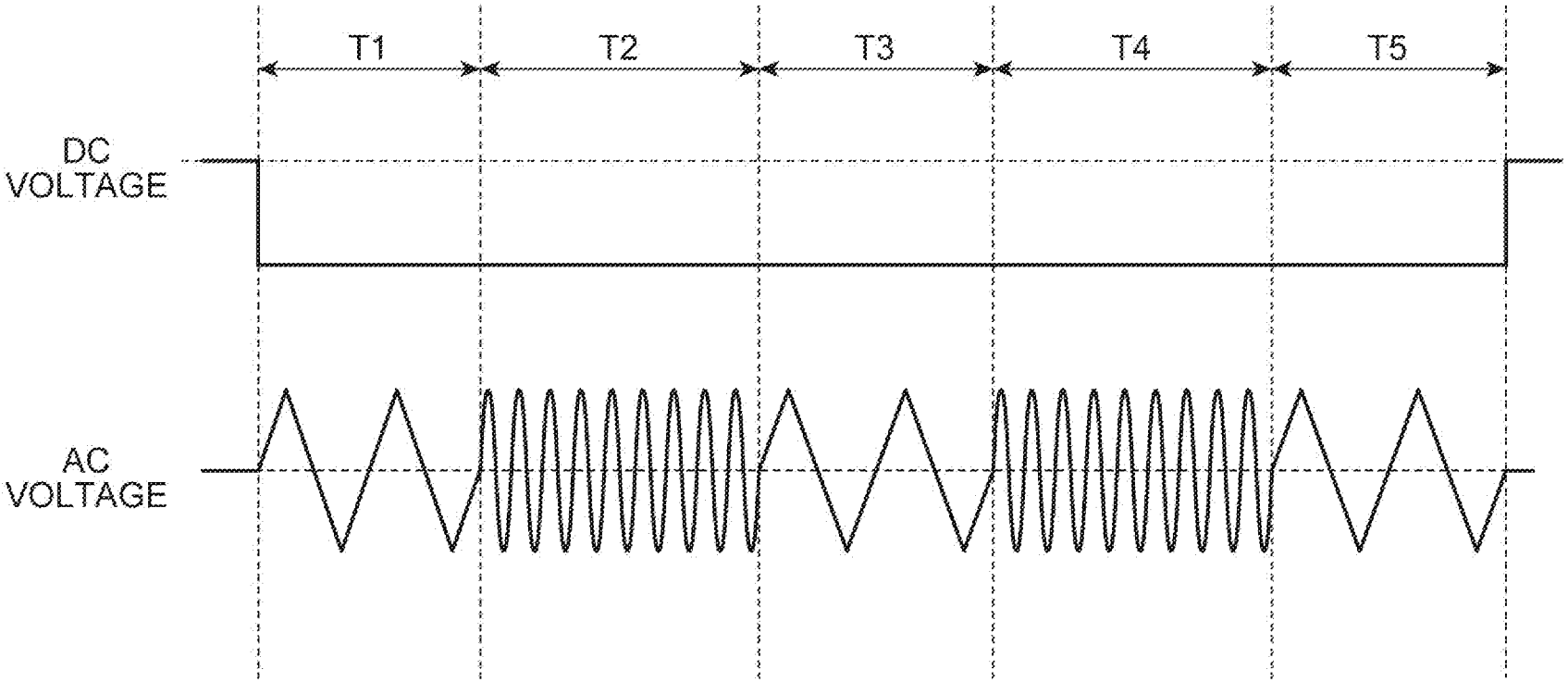
FIG. 9 is a timing diagram illustrating an example of a voltage to be supplied from a power source to the charging device.

FIG. 9 is a timing diagram illustrating an example of a voltage that is supplied to the charging device 41 from the power source 70. Such a timing diagram illustrates an example in which an image is formed on two paper sheets P.

The timing diagram of FIG. 9 includes a period T1 in which the charge potential of the photoreceptor 40 is stabilized, a period T2 in which the image-forming portion 80 for forming the static latent image of the image to be formed on the first sheet of paper (or first paper sheet) P, is charged, a period T3 in which the non-image-forming portion 82 corresponding to a white space and a paper interval, is charged, a period T4 in which the image-forming portion 80 for forming the static latent image of the image to be formed on the second sheet of paper (or second paper sheet) P is charged, and a period T5 in which the photoreceptor 40 is neutralized. The periods T1, T3, and T5 are the non-image-forming period for charging the non-image-forming portions 82 in which no static latent image is formed. The periods T2 and T4 are the image-forming periods for charging the image-forming portions 80 in which a static latent image is formed.

As illustrated in FIG. 9, the controller 72 controls the power source 70, sets the waveform of the AC voltage that is applied to the charging device 41 to the triangle wave, and sets the frequency of the AC voltage to the second frequency f2, in the periods T1, T3, and T5. As a result, the AC current flowing to the photoreceptor 40 during the non-image-forming period decreases, and the wear of the photoreceptor 40 is suppressed.

During the periods T2 and T4, the controller 72 controls the power source 70, sets the frequency of the AC voltage that is applied to the charging device 41 to the sine wave, and sets the frequency of the AC voltage to the first frequency f1. Accordingly, the photoreceptor 40 is homogeneously charged during the image-forming period, and the printing quality of the image is maintained. Furthermore, in all periods of the periods T1 to T5, the DC voltage may be kept constant.

An influence on the wear volume of the photoreceptor 40 at the time of changing the frequency of the AC voltage that was applied to the charging device 41 was evaluated by using the graphs shown in FIG. 4 to FIG. 6. In the following example, the controller 72 applied the AC voltage of the sine wave of 2500 [Hz] to the charging device 41 during the image-forming period, and applied the AC voltage of the sine wave of 300 [Hz] to the charging device 41 during the non-image-forming period. A sequence of printing four paper sheets P was performed, and the wear volume of the photoreceptor 40 was examined by a simulation. The number of rotations of the photoreceptor 40 in one sequence was set to 25 rotations. In addition, a time ratio between the image-forming period and the non-image-forming period was set to 10:15.

In a case where the frequency that is applied to the charging device 41 is 2500 [Hz], a AC current of 2.0 [mA] flows to the photoreceptor 40 (refer to FIG. 5), and accordingly, the wear volume of the photoreceptor 40 per one rotation is 0.018 [nm] (refer to FIG. 4). In a case where the frequency that is applied to the charging device 41 is 300 [Hz], the amount of AC current flowing to the photoreceptor 40 is 0.3 [mA] (refer to FIG. 5), and accordingly, the wear volume of the photoreceptor 40 per one rotation is 0.010 [nm] (refer to FIG. 4).

The wear volume of the photoreceptor 40 at the time of executing one sequence by applying an AC voltage having a frequency of 2500 [Hz] during both of the image-forming period and the non-image-forming period to the charging device 41 is 0.45 [nm] (=0.018 [nm/cycle]×25 [cycle]). The wear volume of the photoreceptor 40 at the time of applying an AC voltage of the sine wave of 2500 [Hz] to the charging device 41 during the image-forming period, and of applying an AC voltage of the sine wave of 300 [Hz] to the charging device 41 during the non-image-forming period is 0.32 [nm] (=0.018 [nm/cycle]×10 [cycle]+0.010 [nm/cycle]×15 [cycle]). Based on such results, when an AC voltage of 2500 [Hz] is applied to the charging device 41 during the image-forming period, and an AC voltage of 300 [Hz] is applied to the charging device 41 during the non-image-forming period, the wear volume of the photoreceptor 40 can be reduced by approximately 30%, as compared with a case where an AC voltage of 2500 [Hz] is applied to the charging device 41 during both of the image-forming period and the non-image-forming period.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

For example, in the example illustrated in FIG. 9, both the frequency and the waveform of the AC voltage that is applied to the charging device 41 during the non-image-forming period are changed. In other examples, either one of the frequency or the waveform of the AC voltage may be changed. In addition, in some of the examples, in order to decrease the AC current flowing to the photoreceptor 40, the waveform of the AC voltage during the AC non-image-forming period is changed to the triangle wave from the sine wave. In other examples, the waveform of the AC voltage during the non-image-forming period may be changed to another waveform, for example, a saw waveform, to decrease the AC current flowing to the photoreceptor 40.

The invention claimed is:

1. An imaging system, comprising:

a photoreceptor including a surface to form a static latent image;

a non-contact charging device being spaced apart from the photoreceptor, the charging device to charge an image-forming portion of the surface of the photoreceptor during an image-forming period and to charge a non-image-forming portion of the surface of the photoreceptor during a non-image-forming period;

a power source to apply a voltage to the charging device; and a controller to change a signal parameter of the voltage to be applied by the power source during the non-image-forming period, in order to adjust a current flowing from the charging device to the photoreceptor, wherein the voltage to be applied by the power source includes a DC voltage and an AC voltage that are superimposed and the signal parameter includes a waveform of the AC voltage, wherein the controller is to change the waveform of the AC voltage to be applied to the charging device during the non-image-forming period in order to decrease the current flowing from the charging device to the photoreceptor relative to the current flowing during the image-forming period, and wherein the controller is to set the waveform of the AC voltage to be applied during the image-forming period to a sine wave, and to set the waveform of the AC voltage to be applied during the non-image-forming period to a triangle wave.

2. The imaging system according to claim 1, wherein the photoreceptor is rotatable to form a charged surface by receiving a charge from the charging device, and to receive light that forms the static latent image on the charged surface, and wherein the image-forming portion includes a region to be exposed to the light that forms the static latent image, and the non-image-forming portion includes a portion to be charged to remain free of exposure from the light.

3. The imaging system according to claim 1, wherein the signal parameter further includes a frequency of the AC voltage, and wherein the controller is to change the frequency of the AC voltage to be applied to the charging device during the non-image-forming period.

4. The imaging system according to claim 3, wherein the controller is to set the frequency of the AC voltage during the image-forming period to a first frequency, and to set the frequency of the AC voltage during the non-image-forming period to a second frequency that is lower than the first frequency.

5. The imaging system according to claim 4, wherein the photoreceptor is rotatable in accordance with a process speed associated with a tangential velocity of the surface of the photoreceptor, wherein a ratio of the first frequency (Hz) to the tangential velocity (mm/sec) of the surface of the photoreceptor is equal to or greater than approximately 8, and wherein a ratio of the second frequency (Hz) to the tangential velocity (mm/sec) of the surface of the photoreceptor is of approximately 1.7 to 8.

6. The imaging system according to claim 3, wherein the DC voltage to be applied by the power source to the charging device is in a range of −900 (V) to −300 (V).

7. The imaging system according to claim 3, wherein the AC voltage to be applied by the power source to the charging device has a peak-to-peak voltage in a range of 1500 (V) to 3000 (V).

8. The imaging system according to claim 1, wherein a closest distance between the charging device and the photoreceptor is in a range of 10 μm to 100 μm.

9. The imaging system according to claim 1, wherein the photoreceptor includes a surface layer formed of an organic compound, and wherein the surface layer contains filler particles having an average particle diameter in a range of 50 nm to 500 nm.

10. The imaging system according to claim 9, wherein the surface layer contains a range of 1 mass % to 30 mass % of the filler particles.

11. The imaging system according to claim 1, wherein the charging device includes:

a conductive support body;

a conductive elastic body layer that is layered on an outer circumferential surface of the conductive support body; and a conductive resin layer that is layered on an outer circumferential surface of the conductive elastic body layer.

12. The imaging system according to claim 11, wherein the conductive resin layer has an electrical resistance that is greater than an electrical resistance of the conductive elastic body layer.

13. A controller for an imaging system including a photoreceptor having a surface to form a static latent image, a non-contact charging device to charge the surface of the photoreceptor, the charging device being spaced apart from the photoreceptor, the charging device to be operated during an image-forming period in which an image-forming portion of the surface of the photoreceptor is charged and during a non-image-forming period in which a non-image-forming portion of the surface of the photoreceptor is charged, and a power source to apply a voltage to the charging device, the controller to:

determine a non-image-forming period; and change a signal parameter of the voltage to be applied by the power source during the non-image-forming period, in order to adjust a current flowing from the charging device to the photoreceptor, wherein the voltage to be applied by the power source includes a DC voltage and an AC voltage that are superimposed and the signal parameter includes a frequency of the AC voltage, wherein the controller is to set the frequency of the AC voltage during the image-forming period to a first frequency, and to set the frequency of the AC voltage during the non-image-forming period to a second frequency that is lower than the first frequency, wherein the controller is to set the waveform of the AC voltage to be applied during the image-forming period to a sine wave, and to set the waveform of the AC voltage to be applied during the non-image-forming period to a triangle wave.

14. An imaging system, comprising:

a photoreceptor to form a static latent image, the photoreceptor having a surface layer including an organic compound and containing filler particles having an average particle diameter in a range of 50 nm to 500 nm;

a non-contact charging device being spaced apart from the photoreceptor, the charging device to charge an image-forming portion of the surface of the photoreceptor during an image-forming period and to charge a non-image-forming portion of the surface of the photoreceptor during a non-image-forming period; and a controller to change a waveform of an AC voltage to be applied by a power source to the charging device during the non-image-forming period to a triangle wave, and to set the waveform of the AC voltage during the image-forming period to a sine wave, to adjust a current flowing from the charging device to the photoreceptor.

15. The imaging system according to claim 14, wherein a voltage to be applied by the power source includes a DC voltage and the AC voltage that are superimposed, and the waveform corresponds to a signal parameter that includes a frequency of the AC voltage, and wherein the controller is to change the frequency of the AC voltage to be applied to the charging device during the non-image-forming period, in order to decrease the current flowing from the charging device to the photoreceptor, relative to the current flowing during the image-forming period.

16. The imaging system according to claim 15, wherein the controller is to set the frequency of the AC voltage during the image-forming period to a first frequency, and to set the frequency of the AC voltage during the non-image-forming period to a second frequency that is lower than the first frequency.

17. The imaging system according to claim 16, wherein the photoreceptor is rotatable in accordance with a process speed associated with a tangential velocity of the surface of the photoreceptor, wherein a ratio of the first frequency (Hz) to the tangential velocity (mm/sec) of the surface of the photoreceptor is equal to or greater than approximately 8, and wherein a ratio of the second frequency (Hz) to the tangential velocity [mm/sec] of the surface of the photoreceptor is of approximately 1.7 to 8.

18. The imaging system according to claim 15, wherein the DC voltage to be applied by the power source to the charging device, is in a range of −900 (V) to −300 (V), and wherein the AC voltage to be applied by the power source to the charging device, has a peak-to-peak voltage in a range of 1500 (V) to 3000 (V).

19. The imaging system according to claim 14, wherein the surface layer contains a range of 1 mass % to 30 mass % of the filler particles.

* * * * *